United States Patent [19]

Higgs et al.

[11] 4,343,515

[45] Aug. 10, 1982

[54] DEVICE FOR ROTATING A BODY

[75] Inventors: Robert H. Higgs, Burton-on-Trent; John M. Jones, Etwall, both of England

[73] Assignee: Coal Industry (Patents) Limited, London, England

[21] Appl. No.: 86,437

[22] Filed: Oct. 19, 1979

[30] Foreign Application Priority Data

Nov. 3, 1978 [GB] United Kingdom ..... 43098/78

[51] Int. Cl.[3] ..... E21C 25/08

[52] U.S. Cl. ..... 299/75; 414/688

[58] Field of Search ..... 299/64, 75, 70; 173/43; 414/688, 705, 742

[56] References Cited

U.S. PATENT DOCUMENTS 3,498,675 3/1970 Kampf-Emden et al. ..... 299/75
3,682,253 8/1972 McIntosh et al. ..... 373/43
3,771,677 11/1973 Pilch ..... 414/688
3,966,256 6/1976 Fikse ..... 414/688 X
4,056,284 11/1977 Stoltefuss et al. ..... 299/75

*Primary Examiner*—William F. Pate, III
*Attorney, Agent, or Firm*—Stevens, Davis, Miller & Mosher

[57] ABSTRACT

The invention relates to a device for rotating a body, such as the boom of a roadheader. The device comprises a pivotally mounted yoke having in it a slot in which is slidably mounted a member which is rotatably and eccentrically attached to the body, and a pair of opposed pivotally mounted rams each of which is rotatably attached to the yoke, the rams being operated out of phase such that they cause the yoke to pivot about its mounting, the pivotal movement being translated into a rotation of the body by movement of the member in the slot. Preferably the member is moved to and fro in the slot by means of a third ram mounted on the yoke.

5 Claims, 6 Drawing Figures

DEVICE FOR ROTATING A BODY

This invention relates to a device for rotating a body, and, in particular but not exclusively, for providing roll-over drive for the boom of a roadheader.

In a mining installation it is necessary to form roadways either alongside a seam of mineral to be mined or from the shaft of the mine to the seam. These roadways may be formed either by blasting or by use of mining machines such as roadheaders.

A roadheader has a cutting head mounted on a boom. The cutting head is, in use, rotated by a motor mounted on the boom to cut the rock in front of the machine. The boom is mounted on a turntable, which enables it to be slewed in a horizontal plane, and is pivotable in a vertical plane by use of elevating rams.

It has been proposed to increase the efficiency of the cutting action of the head by providing a roll-over drive which causes the boom mounting on the turntable to rotate through an angle of 180°. This would be used in the following way to cut out the roadway.

The cutting head is moved into abutment with the rock to be won by use of the turntable and elevating rams. The cutting head, which at all times is rotating, is then caused to cut out an arc of rock by use of the roll over drive, which causes the cutting head to travel through an arc of 180°. At the end of the roll over the head is repositioned to be able to cut another arc, and the roll over drive reactivated. This process is continued until the head had cut out as far as it can reach. The roadheader is then advanced into the roadway and the process begun again on a freshly exposed portion of rock.

Various mechanisms have been proposed for providing the roll-over drive, for instance the use of hydraulic or electric motors driving an epicyclic or normal gear system. However, in order to produce sufficient power to give efficient rock cutting, especially in hard rock, it is necessary to use at least one large motor, and often up to four. These mechanisms are therefore very bulky and cannot be used easily on roadheaders. Other proposals have included the use of an hydraulically activated rack and pinion system. However this also is inefficient and bulky.

It is therefore an object of the present invention to provide a compact and efficient device for providing roll over drive.

Therefore according to the present invention there is provided a device for rotating a body, the device comprising a pivotally mounted yoke having a slot in which is slidably mounted a member adapted, in use, to be attached rotatably and eccentrically to the body, and a pair of opposed pivotally mounted rams each of which is rotatably attached to the yoke, the rams being operated out of phase such that, in use, the rams cause the yoke to pivot about its mounting, the pivotal movement being translated into a rotation of the body by movement of the member in the slot.

Preferably the device includes a third ram connected between the member and the yoke, the third ram being adapted, in use, to move the member to and fro in the slot, the actions of the three rams being such that the body is rotated. The provision of the third ram is an improvement over the two ram system in that it eliminates to a large extent a minimum in the torque supplied by the two ram device. This minimum is not disadvantageous in cutting soft rock, but may cause problems while cutting hard rock.

The device is used to cause rotation by up to 180° in the following way. One of the pair of rams is fully extended, the other is fully retracted and the third ram is fully retracted or extended, the member being at one end of the slot and the yoke being at one end of the pivotal movement. The device is actuated so that as the one ram retracts, the other ram extends and the third ram extends or retracts, the resulting action on the body being rotary. When the pair of rams are halfway through their stroke the action of the third ram is changed so that the rotary motion can continue. The third ram then continues in its new direction until the one ram is fully retracted and the other fully extended, in which position they are stopped. The process is reversed to rotate the body back through the 180° arc.

If it is desired to rotate the body through 360° it is necessary to have the third ram halfway through its stroke when one or other of the pair of rams is fully extended and for it to complete its stroke and be switched over to travel in the opposite direction when the pair of rams are halfway through their stroke. The action of the pair of rams should be reversed when the third ram is halfway through either of its strokes.

Preferably the switching of the direction of action of the rams is carried out automatically, although it may also be carried out manually, especially where the device is only used for rotation up to 180°. In this case it is advantageous for the pair of rams to be controlled manually and the third ram to be switched automatically.

The switches may be electrical switches which operate servo operated valves or may, preferably, be cam actuated hydraulic switches which are tripped by the piston as its moves relative to the cylinder of the ram. The switches may be mounted internally or externally of the ram. Nonetheless any convenient switch may be used.

Preferably the rams are hydraulically operated, although they may also be pneumatically operated.

The provision of the third ram ensures that there is no pronounced minimum in the power supplied to cause rotation of the body, although there will still be a small power minimum. However the device supplies a substantially constant rotary force. Moreover the power supplied to cause rotation may be very large, since the rams may be operated at pressures of up to 200 $kg.cm^{-2}$.

The sliding member may be of any shape but is preferably square and is advantageously provided on each side with a tongue or groove adapted to cooperate with a groove or tongue respectively in each side of the slot.

Conveniently the member is rotatably mounted on the piston of the third ram and is attached to a rod or shaft which is rotatably fixed to the body to be rotated.

Preferably the device is used to provide the roll over drive for a heavy duty roadheader, in which case it is adapted to provide a rotary motion along an arc of 180°. In this case it is desirable to provide a hydraulic lock on each ram so that the roll over drive may be held in position while the slewing and elevating rams are operated. However the device may also be used in many other ways, for instance in turning railway turntables or operating swing bridges, where the weight of the body to be turned is so great as to require a powerful, efficient and compact device.

The present invention will now be described, by way of example only, with reference to the accompanying drawings, in which.

Figure 1:
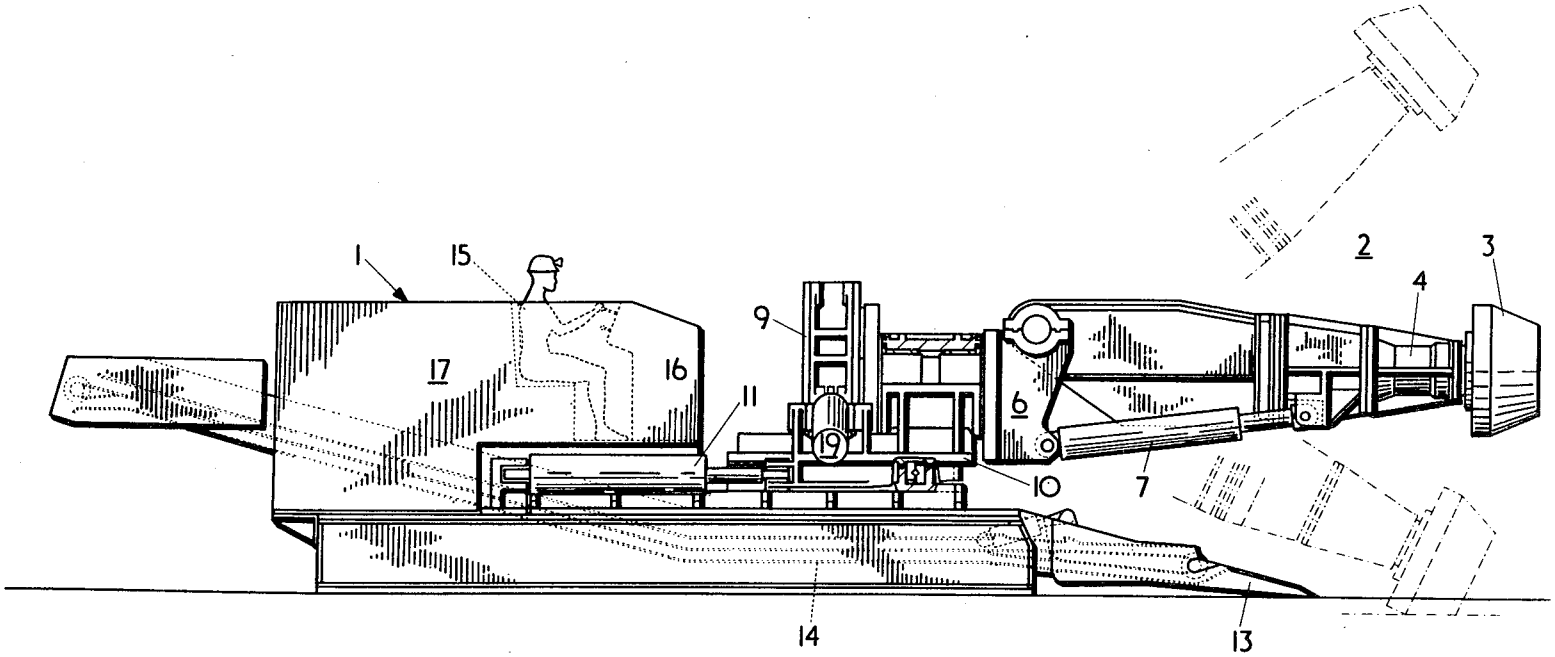
FIG. 1 shows a side view of a heavy duty roadheader including a device according to the present invention.
Figure 2:
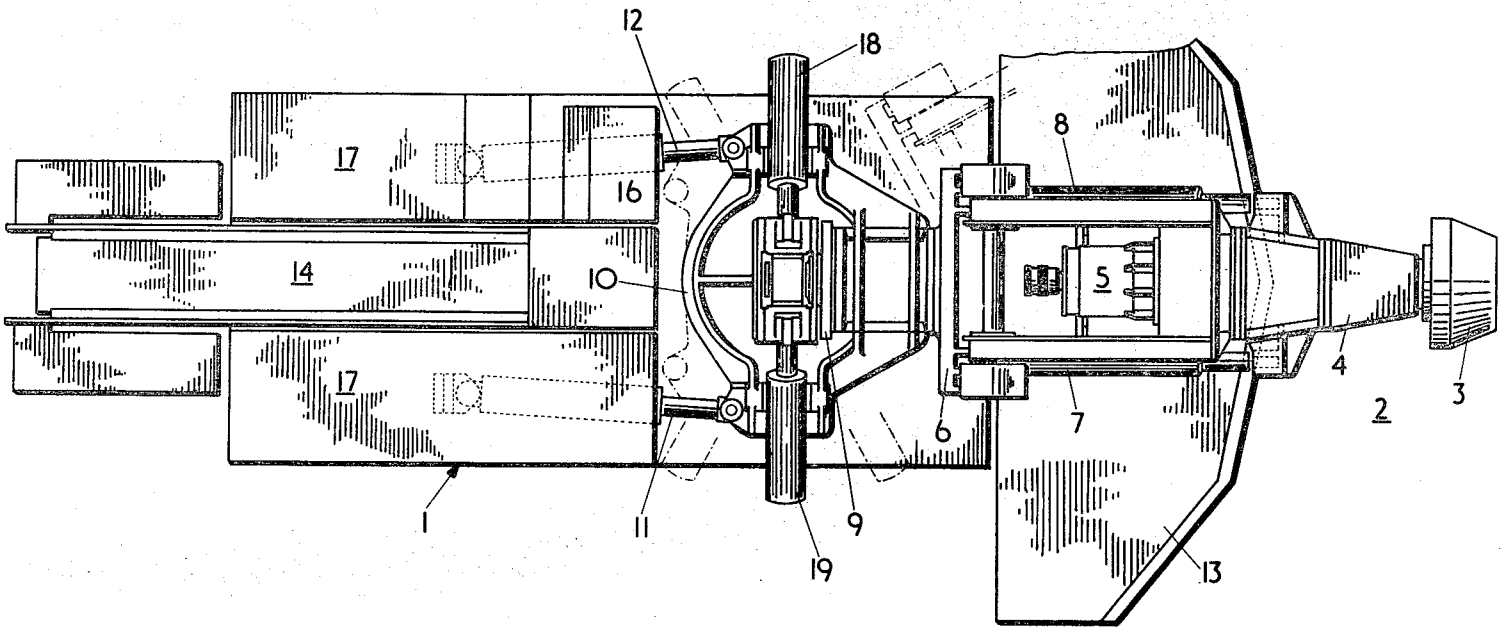
FIG. 2 shows a plan view of the roadheader of FIG. 1.

Referring now to FIGS. 1 and 2, the heavy duty roadheader 1 for driving a roadway 2 in hard rock alongside a coal seam (not shown) is shown. The roadheader 1 comprises a cutting head 3 rotatably mounted on a boom 4. The head, in use, is rotated by an electric motor 5 mounted on the boom 4. The boom 4 is pivotally mounted for movement in a vertical plane on a mounting 6, the pivotal movement being achieved by use of elevating rams 7 and 8 which are also pivotally mounted on the mounting 6 and are pivotally connected to the boom 4. The mounting 6 is connected in a manner to be described in more detail below to a device 9 according to the present invention, which, in use, is used to rotate the mounting 6 through an arc of 180° in vertical plane, that is to provide for the boom a roll over drive. The device 9 is itself mounted on a turntable 10 which can be rotated in a horizontal plane by use of slewing rams 11 and 12.

A loading apron 13 is pivotally mounted on the front of the roadheader 1 and is adapted, in use, to provide a surface over which broken rock may be transported in known manner to conveyor 14 which takes the rock either out of the mine or to the pack alongside the roadway. Since the apron 13 is pivotable it is able to cope with an uneven roadway floor.

The roadheader is controlled by an operator 15 (shown in FIG. 1 in chain lines) seated in front of a control panel 16, which controls the electrical equipment and hydraulic power pack located at 17, as well as the action of the various rams 7, 8, 11, 12, 18, 19 and 33 (see later).

Figure 3:
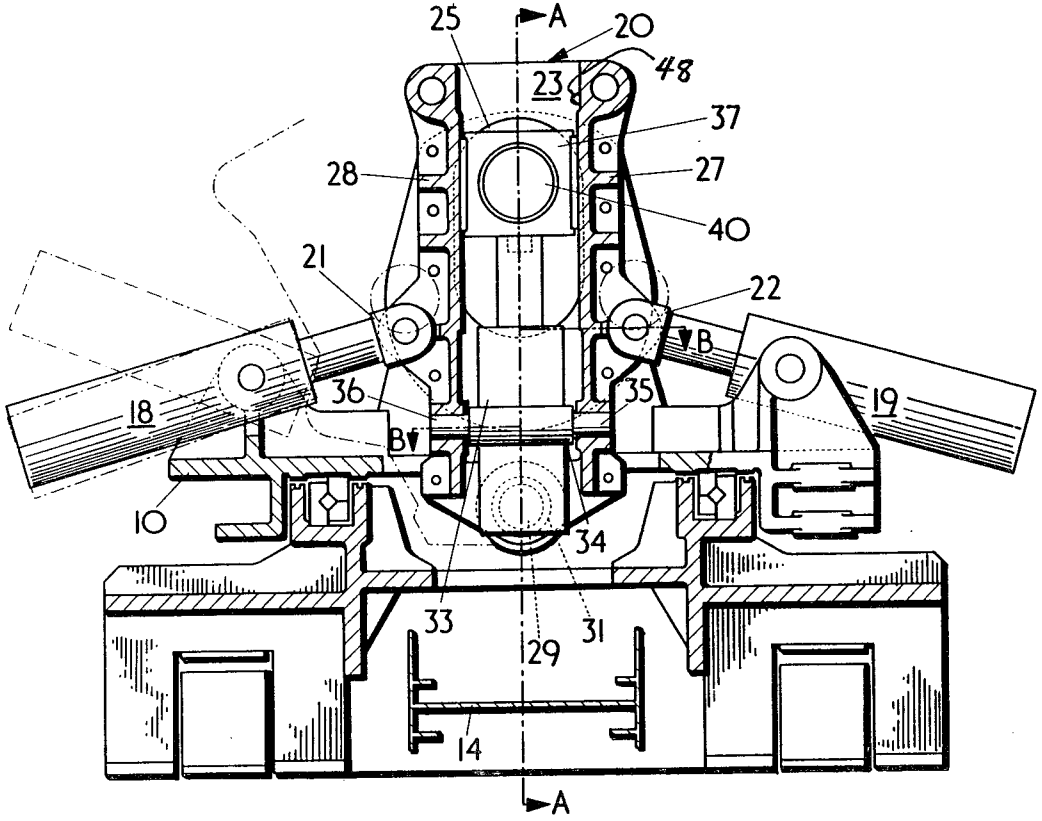
FIG. 3 shows an end view of the device as fitted on the roadheader of FIG. 1.
Figure 4:
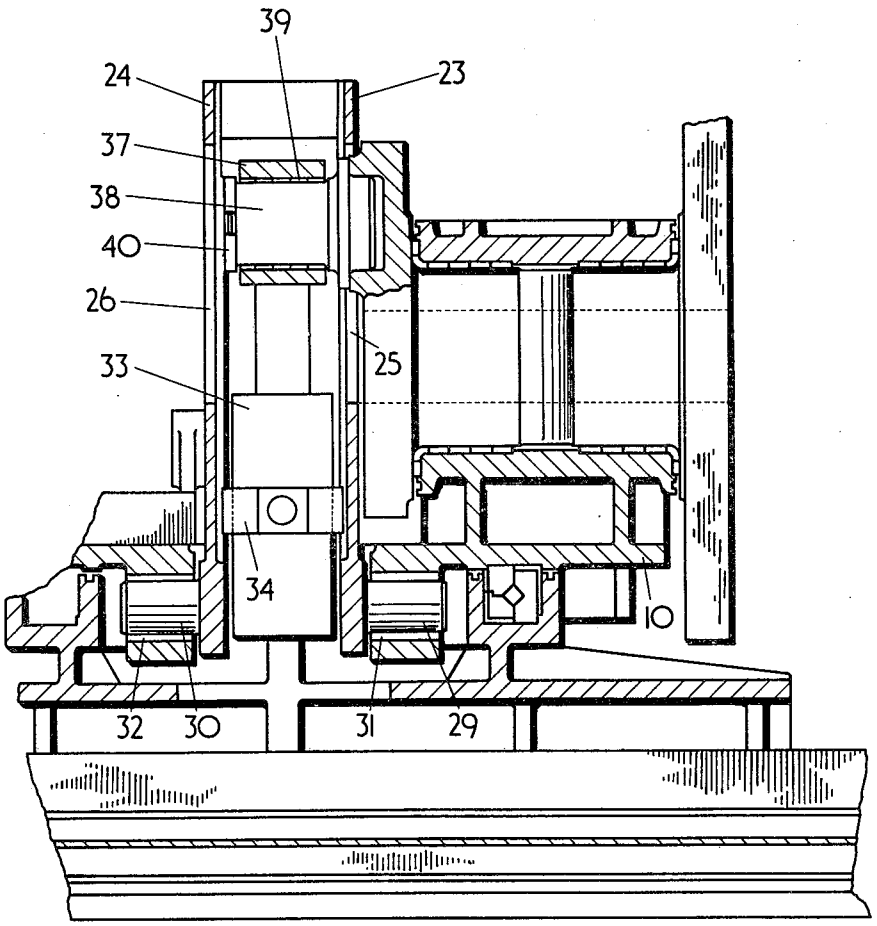
FIG. 4 shows a sectional elevation along line A—A of FIG. 3.

The device 9 according to the invention is shown in detail in FIGS. 3 and 4 to which reference is now also made. The device 9 comprises a pair of opposed pivoting rams 18, 19 whose cylinders are pivotally mounted on the turntable 10 and whose piston rods are pivotally connected to either side of a yoke 20 through heads 21 and 22 respectively. The yoke 20 comprises a pair of opposed plates 23, 24 having in each of them a slot 25, 26 respectively. The plates 23, 24 are held in spaced apart parallel relationship by channel section members 27, 28 which are bolted onto and between the plates 23, 24. The yoke 20 is mounted on shafts 29, 30 fixed to the bottom of each plate 23 or 24 respectively, the shafts 29, 30 being rotatably mounted in a bearing 31 or 32 respectively set in the turntable 10. The yoke 20 is able, in use, to pivot about the shafts 29, 30 in the plane of the action of the pivoting rams 18, 19.

A cranking ram 33 is fixed in a cylindrical bracket 34 which has two diameterically opposed lugs 35, 36 which are fixed into the channel section members 27, 28. Alternatively a part spherical seating may be welded onto the cylinder, the seating fitting into a complementary seat welded onto the yoke. This arrangement imparts a degree of flexibility to the system. A member 37 is fixed onto the piston rod of the cranking ram 33 which, in use, extends and retracts radially relative to the pivotal mounting of the yoke 20. The member 37, in use, moves along the slots 25, 26 and is rotatably connected to a crankshaft 38 fixed eccentrically to the boom mounting 6. The crankshaft 38 extends through a bearing 39 in the member 37 and has on its free-end a flange 40 which prevents the crankshaft 38 and member 37 from becoming disengaged.

The cranking ram 33 is arranged with its head above its cylinder so that while the boom is being lifted (i.e. the ram 33 is extending) the ram 33 is operating on full bore, while when the boom is being lowered the ram 33 is operating on annulus. This compensates to a certain extent for the effect of the weight of the boom, giving smoother roll-over drive.

Figure 5:
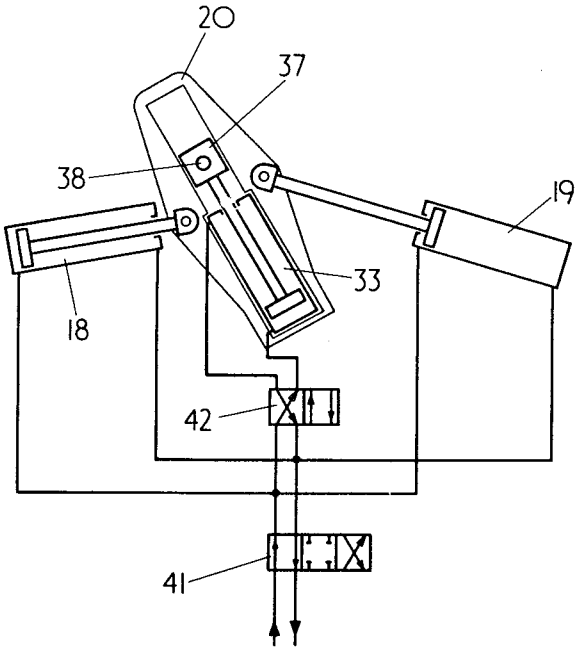
FIG. 5 shows an hydraulic circuit diagram for the device of FIG. 3.

The pivoting rams 18, 19 and the cranking ram 33 are hydraulically operated at pressures of up to 200 $kg.cm^{-2}$ and are controlled as shown in FIG. 5 to which reference is now also made. The pivoting rams 18, 19 are powered such that while one is extending the other is retracting and vice versa and this is achieved by use of manually operated valve 41. The cranking ram 33 is powered such that it extends from its fully retracted position until the pivoting rams 18, 19 are equally extended. (This occurs in this case when the crankshaft 38 is in the top dead centre position shown in FIGS. 3 and 4). The cranking ram 33 is then actuated to retract. This is achieved by use of valve 42 which is operated by abutting a cam 48 in the path of travel of the ram 33 on the member 37 (as shown schematically in FIG. 3) which actuates the valve 42. The control system also includes a pilot operated check valve for each ram, so that it may be hydraulically locked during the use of the slewing and elevating rams.

The roadheader 1 is used in the following manner to extend the roadway 1. The motor 5 is activated to rotate the cutting head 3, and the cutting head 3 is brought into contact with the rock in a desired position by operation of the elevating rams 7, 8 and slewing rams 11, 12. The pilot operated check valves are operated to lock the roll-over drive. The device 9 is then activated to cause the roll over drive, in the following manner, assuming that the roll over drive is beginning with the cranking ram 33 and one pivoting ram 18, fully retracted and the other pivoting ram 19 fully extended.

The hydraulic lock is removed by opening the pilot operated check valves, and the valve 41 is manually operated to cause the ram 18 to extend, the ram 19 to retract and the ram 33 to be powered. As the valve 42 is set the ram 33 will extend. The crankshaft 38 will be located at one end of a notional semi-circle whose diameter is horizontal.

With the rams 18, 19, 33 powered the yoke 20 is caused to pivot from left to right as seen in FIG. 3 and the member 37 to move radially away from the yoke's mounting. The combined effect of these two movements on the crankshaft 38 is to cause it to move along the semi-circle. This action will continue until the valve 42 is activated by the member 37. This will occur when the crankshaft 38 is halfway along the notional semi-circle and is in the position as shown in FIG. 3. The pivoting rams 18, 19 will continue to cause the yoke 20 to pivot as before, but the cranking ram 33 will now cause the member 37 to move radially towards the yoke's pivotal mounting, enabling the crankshaft 38 to continue along the notional semi-circle. The power to the rams is interrupted manually when the pivoting arms are fully extended (18) and fully retracted (19) respectively. The boom elevating and slewing rams may then be used to bring the cutting head into abutment with another portion of the rock. The process of roll over is then reversed.

Figure 6:
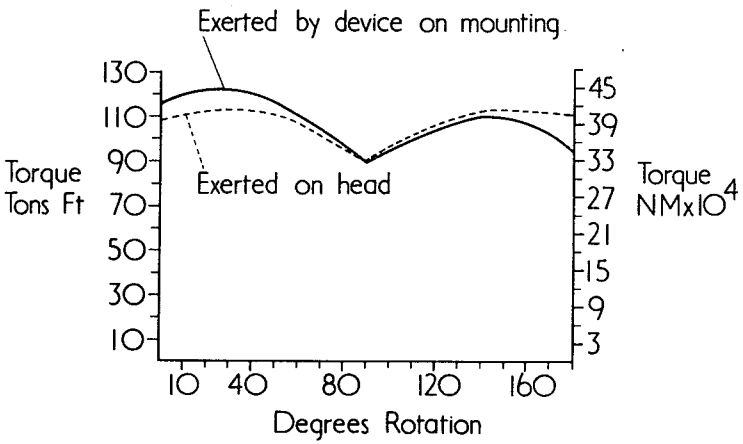
FIG. 6 shows a torque vs rotation graph for the device of FIG. 3.

During the operation of the roll over drive the torque applied to the boom mounting at any point during the travel of the crankshaft along the notional semi-circle is shown in FIG. 6 to which reference is now also made. It can be seen from this that the torque exerted is substantially constant, although clearly not exactly so. However it is considerably better than that obtained using a similar yoke and pivoting rams, but without the cranking ram. Moreover, the actual movement of the head is more linear due to the action of the weight of the boom as shown by the lines on FIG. 6. It can be seen from this that the device according to the present invention provides a more powerful and consistent torque to the boom mounting than was previously achievable, and from a machine which is compact enough to fit easily onto the roadheader turntable.

What we claim is:

1. A device for rotating a body, comprising:

a pivotally mounted yoke having a slot in which is slidably mounted a member adapted, in use, to be attached rotatably and eccentrically to the body;

a pair of opposed pivotally mounted rams each of which is rotatably attached to the yoke and which are connected to be operated out of phase;

a third ram coplanar with the pair of rams connected between the member and the yoke; and switching means which co-ordinate the actions of the rams such that the pair of rams pivot the yoke about its mounting, the third ram moves the member longitudinally to and fro in the slot and the pivotal movement of the yoke and the longitudinal movement of the member is translated into a rotary movement of the body.

2. A device according to claim 1, in which the switching means includes a cam actuated switch mounted on the yoke in the path of travel of the third ram or said member and adapted to reverse the action of the third ram upon its reaching a predetermined position.

3. A device according to claim 2, in which the switching means includes a manually operable switch adapted to reverse the action of the pair of rams.

4. A device according to claim 1, in which the member is provided on each side with a tongue or groove adapted to co-operate with a complementary groove or tongue respectively in the slot.

5. A roadheading mining machine comprising a boom on which is mounted a rotatable cutting head, a pivotally mounted yoke having a slot in which is slidably mounted a member attached rotatably and eccentrically to the boom, a pair of opposed pivotally mounted rams each of which is rotatably attached to the yoke and which are connected to be operated out of phase, a third ram coplanar with the pair of rams connected between the member and the yoke, and switching means which co-ordinate the actions of the rams such that the pair of rams pivot the yoke about its mounting, the third ram moves the member longitudinally to and fro in the slot and the pivotal movement of the yoke and the longitudinal movement of the member is translated into a rotary movement of the boom, thus providing a roll over drive for the roadheader.

* * * * *